US005110230A

United States Patent [19]

Cole, Jr. et al.

[11] Patent Number: 5,110,230

[45] Date of Patent: May 5, 1992

[54] ADJUSTABLE SWIMMING-POOL CLEANING TOOL

[76] Inventors: Mark F. Cole, Jr., 3520 N. Fieta Del Sol West, Tucson, Ariz. 85715; Clyde S. Woods, Jr., 9301 E. 8th St., Tucson, Ariz. 85710

[21] Appl. No.: 658,890

[22] Filed: Feb. 22, 1991

[51] Int. Cl.[5] ..... A46B 11/00

[52] U.S. Cl. ..... 401/52; 401/19; 401/35; 401/39; 401/195; 15/172; 15/144 R; 15/106

[58] Field of Search ..... 401/19, 35, 28, 88, 401/140, 195, 52, 39; 15/144 R, 172, 105, 106, 111, 114, 117

[56] References Cited

U.S. PATENT DOCUMENTS

| | | | |
|---|---|---|---|
| 413,118 | 10/1889 | Warner | 15/144 R |
| 489,828 | 1/1893 | Peterson | 15/114 X |
| 612,491 | 10/1898 | Eck | 15/144 R |
| 1,016,720 | 2/1912 | Vondracek | 15/144 R |
| 2,814,153 | 11/1957 | Martin | 401/88 |
| 3,010,420 | 11/1961 | Glynn | 15/111 X |
| 4,247,216 | 1/1981 | Pansini | 15/172 X |
| 4,396,028 | 8/1983 | Waggoner | 15/144 R |
| 4,893,370 | 1/1990 | Klotz | 15/144 R X |

FOREIGN PATENT DOCUMENTS

| | | | |
|---|---|---|---|
| 342654 | 10/1921 | Fed. Rep. of Germany | 15/114 |
| 537600 | 6/1941 | United Kingdom | 401/88 |

*Primary Examiner*—Danton D. DeMille

*Attorney, Agent, or Firm*—Antonio R. Durando; Harry M. Weiss

[57] ABSTRACT

An adjustable double-purpose tool that is intended for use as an attachment for a standard pool pole. The tool includes a straight handle with a spring-lock for securing it to one end of the pole and a double-faced head for holding a chlorine cake on one side and a scrubbing pad on the other side. The head is pivotally attached to the handle and its orientation can be adjusted at fixed intervals by a key-sprocket mechanism. The mechanism is especially designed so that the key can be actuated from a distance, thus making it possible to adjust the tool without retrieving it from the water.

4 Claims, 2 Drawing Sheets

ADJUSTABLE SWIMMING-POOL CLEANING TOOL

BACKGROUND OF THE INVENTION

1. Field of the Invention

This invention pertains to the general field of pool maintenance tools and, in particular, it provides a new adjustable device for removing algae and other deposits from the plaster surface of swimming pools.

2. Description of the Prior Art

As part of the normal maintenance of swimming pools, it is common practice to remove algae and similar deposits that form and accumulate on the surface of the pool plaster under the water level. Algae are aquatic plants that tend to grow when the chlorine concentration in the water is allowed to drop below the required control level, especially in warm temperatures. Algae are often pigmented with a red, brown or black color that forms characteristic stains at the bottom and along the side walls of the pool.

In order to remove these spots from the pool, an area stained by algae is typically first scrubbed with a wire or similar brush to remove the wax that builds up on algae, and it is treated by the application of solid chlorine cake to saturate it with a high concentration of deadly chlorine. Of course, since pool maintenance is normally performed from outside the pool, both the chlorine cake and the brush are mounted on a retaining tool attached to a long pole.

One such tool is marketed by Pac-Fab of Longwood, Florida, under the trade name "Algee-gon." It consists of two clamp jaws appropriately sized to house a standard 3-inch chlorine cake and held together by two wing-nut bolt combinations at opposite ends along the diameter of the cake. One of the bolts is also inserted through, and therefore forms a pivot point with, a standard spring-lock handle provided for attachment to one end of a pool pole. Thus, the position of the cake with respect to the pole can be varied by rotating the clamp jaws around such pivot point. The ability to reposition the cake is important because it optimizes the use of the tool by permitting adjustments to the angle of attack, which in turn allows for full utilization of the cake's exposed surface and for more effective contact with the algae in areas of the pool that might otherwise be difficult to reach.

A similar product is marketed by Purity Pool of Whitmore, Cali., under the trade name "Mr. Longarm." It consists of a holding jaw for a chlorine cake, pumice stone, or equivalent scraping means, pivotally attached to a quick-connect spring-lock handle. The cake is held in place by a gripping jaw compressed against the holding jaw by two wing-nut bolt combinations. This device can also be adjusted by rotating the position of the cake with respect to the handle, and therefore to the pole attached to it, to conform to the pool bottom for better utilization and results.

While these and similar devices constitute a useful improvement over tools with a fixed angle of attack, several problems remain that the present invention is intended to address. First, as adjustments to the orientation of the tool become necessary during a cleaning session, these prior art devices need to be retrieved from the water, so that the pivot nut can be loosened, the tool rotated, and the assembly retightened as required. This operation is cumbersome and time consuming, especially when working with a long pole in a large pool.

Second, these tools can only be used for the step of treating the algae with chlorine. A different tool with a brush has to be installed either on the same or a different pole to conduct the step of scrubbing the algae off the plaster. Therefore, since both operations are often required at the same time in the same general area of the pool for a complete maintenance service, one is forced to either work with two poles or to extract the pole from the water and switch from one tool to the other as needed. Either one of these alternatives is also very cumbersome and time consuming. Therefore, there still exists a need for a simple device that combines these functions and addresses these problems.

BRIEF SUMMARY OF THE INVENTION

The present invention consists of an adjustable double-purpose tool intended for use as an attachment for a standard pool pole. The tool includes a straight handle with a spring-lock for securing it to one end of the pole and a double-faced head for holding a chlorine cake on one side and a scrubbing pad on the other side. The head is pivotally attached to the handle and its orientation can be adjusted at fixed intervals by a key-sprocket mechanism. The mechanism is especially designed so that the key can be actuated from a distance, thus making it possible to adjust the tool without retrieving it from the water.

One objective of this invention is the development of a mechanism for adjusting the orientation of the chlorine cake or the scrubbing pad without having to reach directly for the tool. This is achieved by the action of a key-sprocket mechanism that can be actuated from a distance by appropriately manipulating the opposite end of the pool pole.

Another objective of the invention is a tool that can be used to perform both chlorination and scrubbing functions at the same time. Therefore, the apparatus described herein features two separate working sides, containing a chlorine cake and a scrubbing pad, respectively.

Another goal of this invention is that it be suitable as an attachment for standard pool poles currently used as extensions for pool brushes, vacuum cleaners, strainers, and other similar maintenance tools. This is obtained by the use of a standard spring-lock handle for connection with such pool poles.

Another objective is that the tool permit a better utilization of the chlorine cake than the devices currently available. Accordingly, the apparatus of this invention requires a relatively small area of contact to hold the cake in place, so that it can be rotated and almost fully utilized as it is being used in the treatment of algae.

Yet another objective of this invention is the realization of the above mentioned goals in an economical and commercially viable manner. This is done by utilizing simple components that are either already available in the open market or can be produced at competitive prices.

Various other purposes and advantages of this invention will become clear from its description in the specifications that follow, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

The most important part of this invention lies in the novel key-sprocket mechanism that provides the means by which the tool can be adjusted and locked in place from a distance. In addition, the invention features two functional sides for alternative utilization, whereby chlorinating means and scrubbing means can be available for alternative use at the same time.

Figure 1:
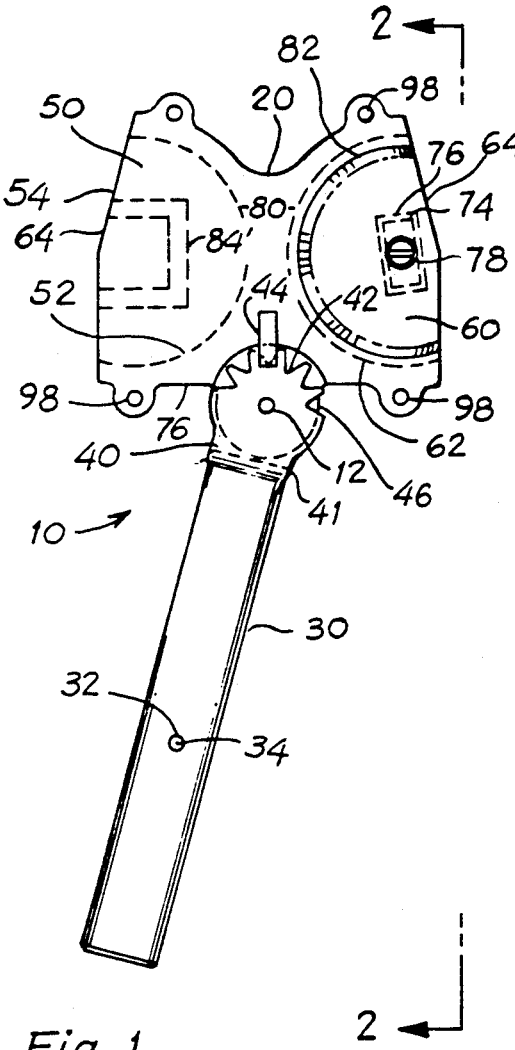
FIG. 1 is an elevated view of the preferred embodiment of the tool according to this invention wherein the pivotal working engagement of the head and handle is illustrated.

Referring to the drawings, wherein like parts are designated throughout with like numerals and symbols, FIG. 1 shows the tool 10 of the invention before attachment to a pool pole and before incorporation of cleaning attachments, such as a chlorine cake and a wire or nylon scrubbing pad. The tool includes two main components, a head 20 and a handle 30, that are pivotally joined through an axle 12. The handle 30 consists of a cylindrical body approximately one inch in diameter for fitting into and attaching to one end of a standard pool pole. A spring lock 32 is available for engagement with standard receiving holes found in pool poles to ensure a rapid and firm connection. As shown in the cut-out portion of FIG. 2, the spring lock 32 consists of a standard combination of two spring-loaded pins 34 protruding diametrically from the cylindrical space occupied by the handle 30. A spring 36 pushes outwardly against the pin heads 38 to ensure that the pins 34 are normally in an extended position and, therefore, able to lock the handle 30 in place through the receiving holes of any conventional pool pole. The pins 34 can be pressed inward by manual pressure to permit the handle to slide in and out of the pole. Preferably, as illustrated in FIG. 1, one end of the handle 30 is slightly enlarged to form a portion 41 with a diameter larger than that of the handle in order to prevent it from sliding completely into the receiving end of the pole. The same end of the handle also forms a bifurcated frame for supporting the axle 12, wherein each side of the fork consists of a flat flange 40 ending with a semicircular sprocket 42.

Figure 2:
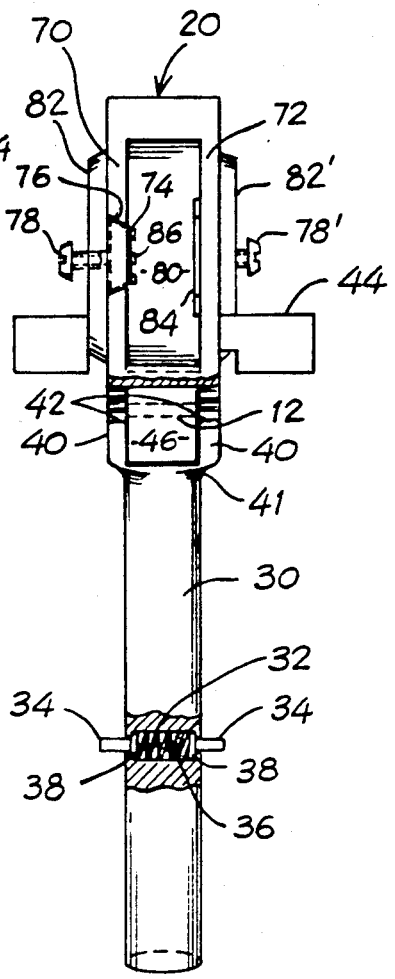
FIG. 2 shows a side view of the same embodiment of the invention taken from line 2—2 in FIG. 1, wherein a portion of the handle is cut out to illustrate its spring-lock mechanism and a portion of the head is cut out to show the pivotal connection between the head and the handle.

The head 20 consists of two approximately semicircular housings, 50 and 60, facing opposite directions and designed to hold a standard three-inch chlorine cake or a scrubbing pad about three to six inches in diameter (not shown in the figures). Scrubbing pads normally constitute a resilient mass that can be easily compressed to fit snugly into a smaller volume. The two housings in the head 20 are identical and each can be used for either function. Each housing is defined by the enclosure formed by two exterior plates, 70 and 72, and a concave semicircular edge of the solid core 80 of the head 20. Thus, the first housing 50 consists of the space defined by the solid interior boundary 52 between the two plates 70 and 72, the exterior boundary 54 remaining open for insertion of cleaning attachments, such as a chlorine cake or a scrubbing pad. Similarly, the second housing 60 consists of the space defined by the solid interior boundary 62 and the open boundary 64. Both housings are identical in construction and function; therefore, the side view of housing 60 shown in FIG. 2 is also representative of housing 50 viewed from the other side and only one housing is described in detail here.

The space defined by each housing is approximately the same as the dimensions of the chlorine cake that they are intended to house. For example, although the scope of the invention is not limited to this application, the housings of the preferred embodiment are approximately three inches in diameter and one inch in thickness, so as to accommodate the size of the most commonly used chlorine cake. Thus, the cake is supported in place by the contour of the housing along the line 62, which permits considerable force to be exerted on the cake as it is being rubbed against the bottom of a pool without causing it to become loose and separate from its housing. As is shown in FIGS. 1 and 2 with respect to the right housing 60, a beveled portion of the plate 70 is cut out roughly at the center of the approximate semicircle delineated by the boundary 62 and it is used to provide a clamp 74 to press laterally against the chlorine cake. The beveled cut must be thick enough to provide some inward travel space for the clamp 74, but not so much that the clamp can be totally released from the beveled edges of the opening 76 created in the plate 70. A clamp screw 78, screwably mounted on a support plate 82, is provided to push against the clamp 74 to exert the desired pressure on the cake or pad to be held in the housing 60. A set of small ridges 86 may be incorporated into the interior face of the clamp 74 to increase its clamping effectiveness. A ridge 84 may also be provided on the interior surface of the plate 72 on the opposite side for a firmer grip on the cake or pad. Notice that an identical ridge 84' is provided in the housing 50 on the other side of the head 20' as seen in segmented line in FIG. 1. Similarly, FIG. 2 shows a corresponding clamp screw 78, and support plate 82, on the back side of the housing 50.

In use, either side of the head 20 can be equipped with a chlorine cake or a scrubbing pad by inserting it into the corresponding housing and by clamping it in place by turning the clamp screw to press against it. Because of the shape of the housings 50 and 60, a new chlorine cake can be used without adjustment until consumed to the housing's outer edge (54 or 64, as the case may be).

Afterwards, the cake can be rotated 180 degrees and clamped back in position through its remaining center portion, so that it can be utilized to its fullest before replacement. Similarly, because of the containment support provided by either housing, a conventional nylon or wire scrubbing pad can be stuffed into the housing and retained in place during service by the relatively modest pressure exerted on it by the set of ridges 86 and 84.

Figure 3:
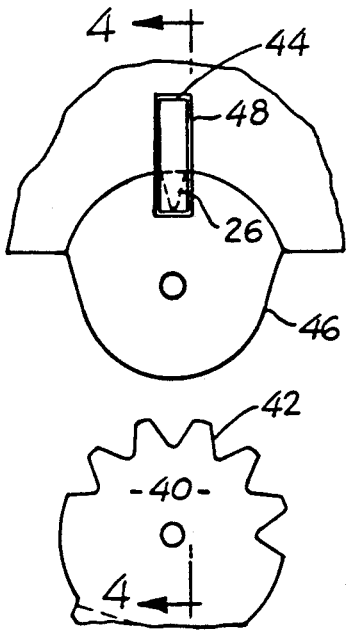
FIG. 3 is a more detailed view of the pivoting point and the key-sprocket mechanism of the invention, wherein the head and handle have been separated for illustration.

As mentioned above, the head 20 of the tool 10 is pivotally joined to the handle 30 by an axle 12, which anchors the neck portion 46 of the head to the two sprocketed flanges 40 of the handle. A slidable key 44 is positioned through a receiving opening 48 in the solid core 80 of the head to engage the teeth of the sprocket 42 to lock the head 20 in fixed relative position with respect to the handle 30. As seen in more detail in FIGS. 3 and 4, which show the head and handle of the tool separated for convenience of illustration, the key 44 consists of a rigid member of generally uniform cross-section slideably mounted in the transverse opening 48. The key 44 features several distinct portions that give it its functional characteristics, comprising two end portions 27, two lower teeth 26, a middle portion 25, and an upper tooth 22. As shown in FIG. 3, the cross-section of the key 44 in this embodiment of the invention is generally rectangular, but any shape is acceptable to practice the invention so long as the opening 48 conforms to provide a cooperative combination in sliding arrangement. In addition, the cross-section of the end portions 27 must be sufficiently wide to preclude their meshing with the teeth of the sprockets 4 in the flanges 40 of the handle.

Figure 4:
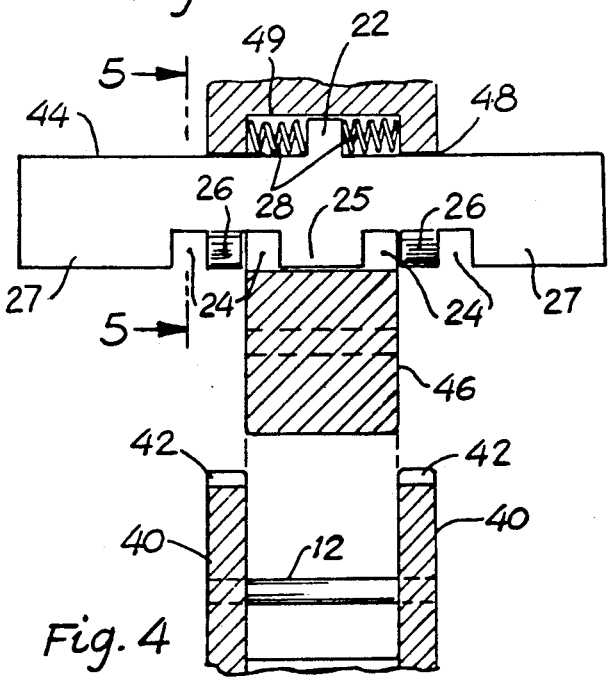
FIG. 4 shows a cross-sectional view of the detail illustrated in FIG. 3 taken from line 4—4 in that figure.
Figure 5:
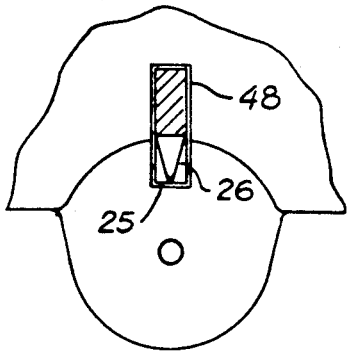
FIG. 5 shows a cross-sectional view of the locking key taken from line 5—5 in FIG. 4.
Figure 6:
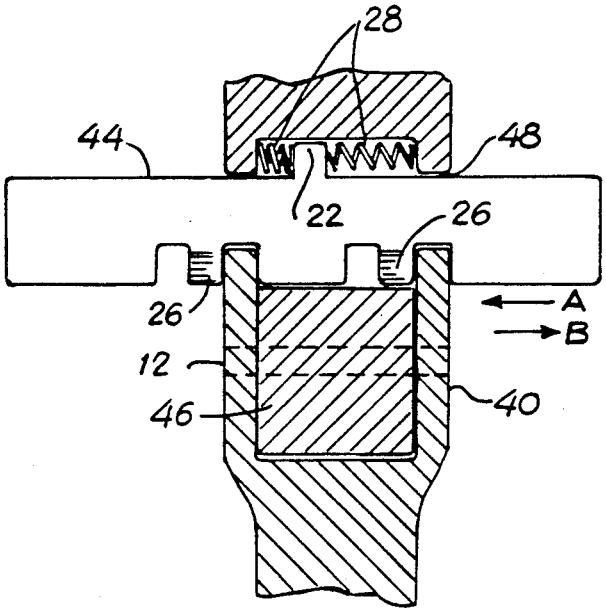
FIG. 6 is an illustration of the position of the locking key of the invention when the key-sprocket mechanism is disengaged to permit the rotation of the tool's head in relation to the handle, shown as a cross-sectional view taken from the same plane defined by line 4—4 in FIG. 3, but with the head and handle having been reconnected.

As seen in FIG. 4, the central portion of the opening 48 features an inset 49 designed to receive the upper tooth 22 that extends upwards from the middle portion 25 of the key. The tooth 22 is spring loaded on both sides by two springs 28 that keep the key 44 in a normally-centered position of rest unless pressure is exerted on it in one direction or the other along its axis. The springs 28 should be equal in strength and capable of being compressed by the weight of the head 20 of the tool. The middle portion 25 of the key is otherwise uniform and conforms to the shape of the opening 48. Between the middle portion 25 and the end portion 27 on each side of the key, two indentations 24 are present, of sufficient depth and width to allow the handle 30 to freely rotate when the key 44 is positioned so that each set of indentations 24 is lined up with the corresponding sprocket 42 (as illustrated in FIG. 6). Finally, each set of indentations 24 forms a tooth 26 of comparable width and with a cross-section that becomes pointed towards the bottom to form a shape that allows it to mesh with the gears in the corresponding sprocket 42. FIG. 5, which is a cross-sectional view of the key 44 taken from line 5—5 in FIG. 4, shows the difference in the cross-sectional shapes of the tooth 26, which can be engaged by the gears of the sprocket 42, and of the middle portion 25, which is too wide to mesh with the same gears.

The result of this structural configuration is that under normal conditions the teeth 26 are always engaged by one of the spaces between gears in the sprockets 42 and, therefore, that the head 20 is normally locked in a firm relative position with respect to the handle 30 of the tool. In order to vary this position, the key must be pushed in either direction through the opening 48 and against the pressure exerted by the springs 28 to release the teeth 26 from the gears. FIG. 6 illustrates this condition after pushing the key 44 in the direction of the arrow A. At this point, the head is free to rotate around the axle 12 to a new position, as desired by the user. Upon release of the pressure exerted on the key, the set of springs 28 automatically returns the key to its rest position through a return motion in the direction indicated by arrow B, thus causing the teeth 26 to mesh with a new set of gears and lock the head in place in its new position. The same result can be obtained, of course, by operating the key in the opposite direction.

The embodiment illustrated in the figures shows five teeth in each sprocket 42, corresponding to six meshing positions covering approximately 180 degrees. This number can obviously be changed to provide finer or coarser adjustments to the position of the head without changing the scope of the invention. Similarly, an odd number of teeth in symmetrical arrangement produces a tool wherein the head cannot be set in a position perpendicular to the handle, resulting in the two sides of the head always having different angles of attack. While this feature is considered preferable, it is not an essential element of the invention.

Figure 7:
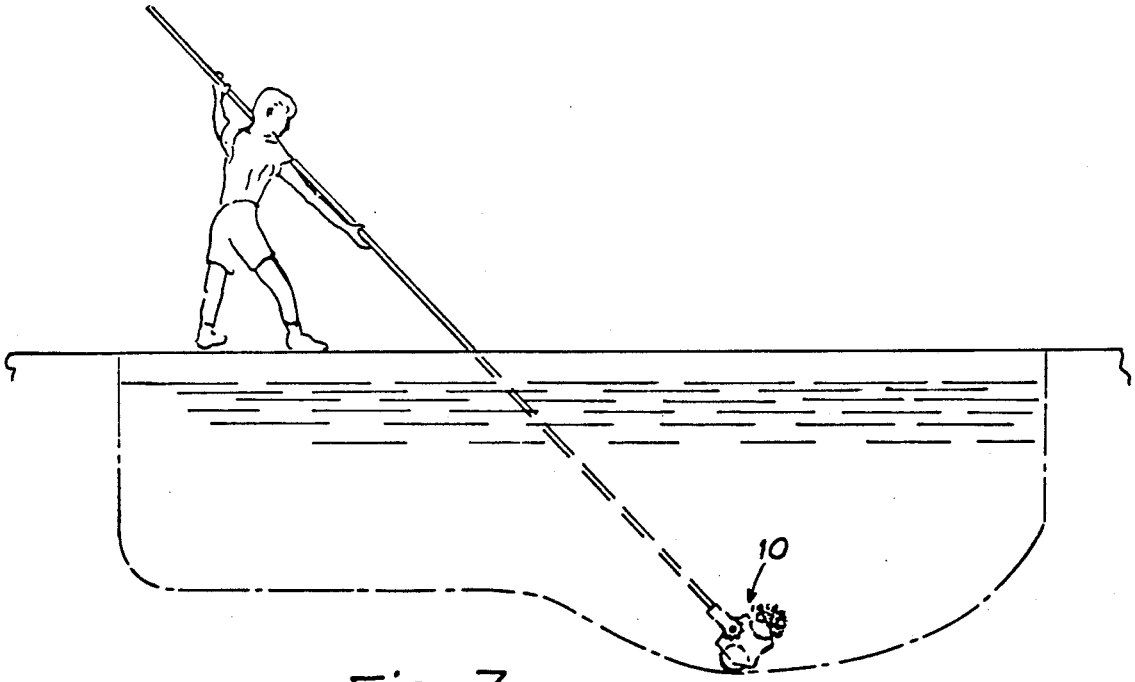
FIG. 7 illustrates the tool of this invention in typical use for cleaning algae spots in a pool.

When the tool 10 is used to treat algae in a swimming pool, it is connected to a standard pole through the spring lock 32 and used to scrub and apply chlorine to algae spots in the plaster walls and bottom of the pool, as illustrated in FIG. 7. Depending on the location of the spot being treated or on the wear in the chlorine cake, a different angle of attack may be desired to produce best results. Accordingly, the head 20 may be rotated in the manner shown above to obtain the optimal angle of attack. By turning the tool so that one of the end portions 27 of the key 44 is frictionally engaged with the bottom of the pool, sufficient pressure is exerted on it by the weight of the tool to cause it to slide and release the sprockets 42. The position of the head 20 relative to the handle 30 can then be adjusted by maneuvering the pole in the desired direction, at which point it can be locked in place again simply by lifting the tool from the pressure point and allowing the key to return to its rest position through a new set of gears.

Thus, because of its two-face feature, the tool of this invention permits a user to deposit chlorine cake on algae spots and to scrub all at the same time simply by switching service face while the tool is in the water. At the same time, the tool permits adjustments in the angle of attack of the tool that increase its effectiveness and improve the utilization of the chlorine cake. Unless a new chlorine cake is needed, no need exists to remove the tool from the water for adjustments or replacement of attachments.

Note that the configuration and size of the housings 50 and 60 of the preferred embodiment are designed for chlorine cakes of standard dimensions, but they could be easily modified within the purview of the invention to accommodate any kind of cleaning attachments. The invention is directed at a holder for any combination of cleaning attachments that are used from a distance with the aid of an extension pole and that might require periodic adjustments to their angle of attack to the working surface.

The various structural parts of the invention are suitable for construction with any rigid material that is not affected by pool water, such as plastic or metal. Because of the symmetrical configuration of the head 20, it is expected that it would be assembled by joining two identical halves by rivets 98, as shown in Figures 1, or by other equivalent means. It is also expected that the end portions 27 of the locking key would be covered with a rubberized coating (not shown in the drawings), or by an equivalent structure, in order to protect the pool plaster from scratches when the key is pegged against it to adjust the position of the tool.

Thus, various changes in the details, steps and materials that have been described may be made by those skilled in the art within the principles and scope of the invention herein illustrated and defined in the appended claims. While the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

We claim:

1. An adjustable double-purpose cleaning tool for alternative utilization between two functional sides, comprising:

(a) a head for housing two cleaning attachments on opposite sides, said head comprising two concave semicircular surfaces enclosed by two exterior plates to form two approximately semicircular housings facing opposite directions for receiving the two cleaning attachments, and further comprising a neck portion in fixed rigid relationship to said housings;

(b) a handle, adjustably pivotally joined to said neck portion, for attaching to one end of an extension pole;

(c) spring-loaded locking means for adjusting the relative pivotal position of said neck portion and said handle to produce a desired angle of attack for said cleaning attachments with respect to their working surfaces;

(d) a screwably adjustable clamp located approximately at the center of each of said two semicircular housings for exerting lateral retaining pressure against the cleaning attachments housed therewithin; and (e) a set of small ridges incorporated into the interior of each of said semicircular housings and on the face of said screwably adjustable clamp for increasing its clamping effectiveness by producing a firmer grip on the cleaning attachments.

2. The cleaning tool defined in claim 1, wherein each of said two approximately semicircular housings is approximately three inches in diameter and one inch in thickness, so as to accommodate a standard three-inch chlorine cake and support it in place against the interior semicircular contour of the housing, which permits considerable force to be exerted on the cake without casing it to become loose during use.

3. An adjustable double-purpose cleaning tool for alternative utilization between two functional sides whereby chlorinating means and scrubbing means are available at the same time, comprising:

(a) a head for housing chlorinating and scrubbing means on opposite sides, said head comprising two approximately semicircular housings, facing opposite directions, consisting of enclosures formed by two exterior plates and concave semicircular edges in said head; a screwably adjustable clamp located approximately at the center of each of said two housings for exerting lateral retaining pressure against said chlorinating and scrubbing means; a set of small ridges incorporated into the interior face of said screwably adjustable clamp for increasing its clamping effectiveness; and a set of small ridges on the interior opposite-side surface for a firmer grip on said chlorinating and scrubbing means; wherein each of said two approximately semicircular housings is approximately three inches in diameter and one inching thickness; and wherein said head includes a neck potion hinged to an axle;

(b) a handle, pivotally hinged to said head, for attaching to one end of a standard swimming-pool pole, said handle compirsing a cylindrical body approximately one inch in diameter for fitting into said standard swimming-pool pole, and a spring lock for engagement with standard receiving holes in said pole to ensure a rapid and firm connection; wherein said spring lock consists of a combination of two spring-loaded pins protruding diametrically from the space occupied by said cylindrical body and having a spring pushing outwardly against the heads of said pins to ensure that they are normally in an extended position; wherein one end of said cylindrical body is slightly enlarged to prevent it from sliding completely into the receiving end of said pole used in conjunction therewith; and wherein the other end of said cylindrical body forms a bifurcated frame supporting said axle, with each side of said bifurcated frame consisting of a flat flange ending with a semicircular sprocket; and (c) a spring-loaded key-sprocket lock for adjusting the relative pivotal position of said head and said handle to produce a desired angle of attach for said chlorinating and scrubbing means, said lock comprising a slidable key positioned through a receiving opening in said head; wherein said slidable key meshes with said sprockets to lock said head in fixed relative position with respect to said handle; wherein said slidable key further consists of a rigid member of generally uniform cross-section including two lower teeth capable of meshing with said sprocket; two sets of indentations, adjacent to each of said lower teeth and of sufficient depth and width to allow said handle to freely rotate when said key is positioned to that said indentations are lined up with said sprockets; two end portions and a middle portion, all sufficiently wide to preclude them from meshing with the teeth of said sprockets; and a spring-loaded upper tooth extending upwards into said head from said middle portion to keep said key in a normally-centered position of rest unless pressure is exerted on it in either direction along its axis; and wherein, finally, the spring mechanism of said spring-loaded upper tooth is capable of being compressed by the weight of said head means of the tool.

4. A method of chlorinating and scrubbing swimming pool plaster with an adjustable double-purpose cleaning tool permitting the alternative utilization of two functional sides and the adjustment of the angle of attach of the tool without retrieving it from the water, comprising the steps of:

(a) providing a head for housing chlorinating means and scrubbing means on opposite sides, said head comprising two approximately semicircular housings, facing opposite directions, consisting of the enclosures formed by two exterior plates and concave semicircular edges in said head; a screwably adjustable clamp located approximately at the center of each of said two housings for exerting lateral retaining pressure against said chlorinating means and scrubbing means; a set of small edges incorporated into the interior face of said screwably adjustable clamp for increasing its clamping effectiveness; and a set of small ridges on the interior opposite-side surface for a firmer grip on said chlorinating means an scrubbing means; wherein each of said two approximately semicircular housings is approximately three inches in diameter and one inch in thickness; and wherein said head includes a neck portion hinged to an axle;

(b) providing a handle, pivotally hinged to said head, for attaching to one end of a standard swimming-pool pole, said handle comprising a cylindrical body approximately one inch in diameter for fitting into said standard swimming-pool pole, and a spring lock for engagement with standard receiving holes in said pole to ensure a rapid and firm connection; wherein said spring lock consists of a combination of tow spring-loaded pins protruding diametrically from the space occupied by said cylindrical body and having a spring pushing outwardly against the heads of said pins to ensure that key are normally in an extended position; wherein one end of said cylindrical body is slightly enlarged to prevent it from sliding completely into the receiving end of said pole used in conjunction therewith; and wherein the other end of said cylindrical body forms a bifurcated frame supporting said axle, with each side of said bifurcated frame consisting of a flat flange ending with a semicircular sprocket;

(c) providing a spring-loaded key-sprocket lock for adjusting the relative pivotal position of said head and said handle to produce a desired angle of attack for said chlorinating means and scrubbing means, said lock comprising a slidable key positioned through a receiving opening in said head; wherein said slidable key meshes with said sprockets to lock said head in fixed relative position with respect to said handle; wherein said slidable key further consists of a rigid member of generally uniform cross-section including two lower teeth capable of meshing with said sprockets; two sets of indentations, adjacent to each of said lower teeth and of sufficient depth and width to allow said handle to freely rotate when said key is positioned so that said indentations are lined up with said sprockets; two end portions and a middle portion, all sufficiently wide to preclude them from meshing with the teeth of said sprockets; and a spring-loaded upper tooth extending upwards into said head from said middle portion to keep said key in a normally-centered position of rest unless pressure is exerted on it in either direction along its axis; and wherein, finally, the spring mechanism of said spring-loaded upper tooth is capable of being compressed by the weight of said head means of the tool;

(d) inserting said chlorinating means into one of said approximately semicircular housings and said scrubbing means into the other, and using said screwably adjustable clamp to fasten them in place;

(e) attaching said handle to a swimming-pool pole;

(f) alternatively using either of said chlorinating and scrubbing means to clean the plaster of a swimming pool; and (g) adjusting the angle of attach of said chlorinating means and said scrubbing means, as required during the operation of the cleaning tool, by engaging the key of said spring-loaded key-sprocket lock against the bottom of the pool while the tool remains in the water.

* * * * *